US006877804B2

(12) United States Patent
Chan

(10) Patent No.: US 6,877,804 B2
(45) **Date of Patent: *Apr. 12, 2005**

(54) FOLDING CHAIR

(75) Inventor: Alexander Guy Chan, Orinda, CA (US)

(73) Assignee: Portfolio Productions, Inc., Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/759,778

(22) Filed: Jan. 16, 2004

(65) Prior Publication Data

US 2004/0145220 A1 Jul. 29, 2004

Related U.S. Application Data

(63) Continuation of application No. 10/098,664, filed on Mar. 15, 2002, now Pat. No. 6,698,828.

(51) Int. Cl.[7] ..... A47C 4/00

(52) U.S. Cl. ..... 297/54; 297/53; 297/52; 297/51

(58) Field of Search ..... 297/54, 51, 52, 297/53

(56) References Cited

U.S. PATENT DOCUMENTS

| | | | |
|---|---|---|---|
| 125,556 | A | 4/1872 | Everickx |
| 924,396 | A | 6/1909 | Spoljar |
| 1,302,828 | A | 5/1919 | Miller |
| 1,944,335 | A | 1/1934 | Van Wyck |
| 1,984,238 | A | 12/1934 | Spanopoulos |
| 2,517,039 | A | 8/1950 | Shook |
| 3,005,659 | A | 10/1961 | Sanders |

*Primary Examiner*—Anthony D. Barfield
(74) *Attorney, Agent, or Firm*—Mark J. Spolyar

(57) ABSTRACT

A folding chair having a novel hinge and joint surface configuration that forms a substantially rigid structure approximating conventional non-folding chair designs. In one embodiment, the present invention provides a folding chair comprising a seat frame, a backrest frame hinged proximally to the rear edge of the seat frame and forwardly collapsible over the upper surface of the seat frame, and back legs hinged to the rear edge of the seat frame and forwardly collapsible over the lower surface of the seat frame. The chair, in one embodiment, further comprises front legs hinged to the seat frame and collapsible over the back legs. In an assembled state, the back legs and the backrest frame each abut against elements of the chair at joint surfaces, which limit the range of motion of the hinged members to thereby create a chair having a rigid support structure. In one embodiment, the seat frame, backrest frame, and back legs unfold into an interlocked configuration enhancing the stability of the chair.

21 Claims, 7 Drawing Sheets

Fig._1B
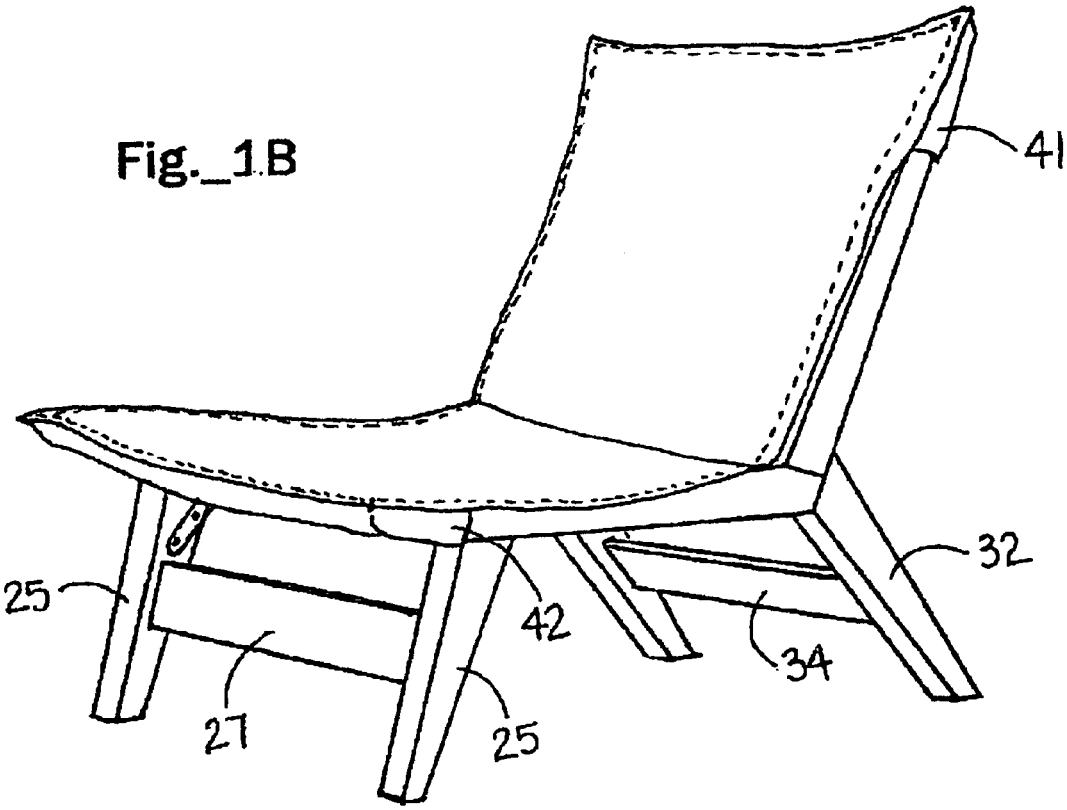
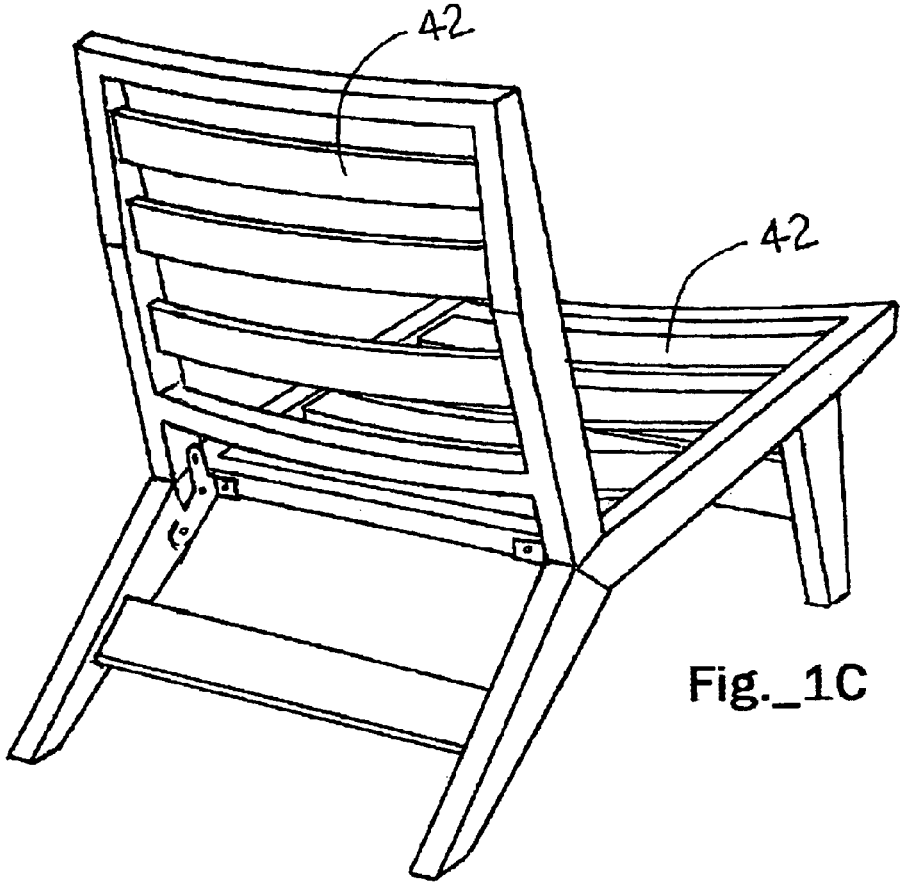
Fig._1C

FOLDING CHAIR

CROSS-REFERENCE TO RELATED APPLICATION

The present application is a continuation application of U.S. patent application Ser. No. 10/098,664 filed Mar. 15, 2002, now U.S. Pat. No. 6,698,828, entitled "Folding Chair" which is incorporated herein by reference for all purposes.

FIELD OF THE INVENTION

The present invention relates to folding chairs and, more particularly, to folding chairs having a novel hinge-joint surface configuration that forms a substantially rigid structure approximating conventional non-folding chair designs.

BACKGROUND OF THE INVENTION

Folding chairs of a variety of configurations are known in the art. Indeed, an intended advantage of folding chairs is that, in a folded state, they may be shipped or stored more conveniently than non-folding or fully assembled chairs. Conventional folding chairs generally include a backrest frame having legs that extend at downward angles to become the front legs of the chair, back legs pivotally mounted to the back rest frame, and a seat frame pivoted to the backrest frame, and the back legs. In addition, the prior art is replete with a wide variety of hinge and joint configurations to support and guide the folding members.

While the folding chairs of the prior art fulfill their respective objectives, the folding chair configurations of the prior art often sacrifice stability and durability relative to traditional, non-folding chairs, to achieve their respective functions. Accordingly, a need exists in the art for a folding chair that erects into a stable from approximating traditional, non-folding chairs. Embodiments of the present invention substantially fulfill this need.

SUMMARY OF THE INVENTION

The present invention provides a folding chair having a novel hinge and joint surface configuration that forms a substantially rigid structure approximating conventional non-folding chair designs. In one embodiment, the present invention provides a folding chair comprising a seat frame, a backrest frame hinged proximally to the rear edge of the seat frame and forwardly collapsible over the upper surface of the seat frame, and back legs hinged to the rear edge of the seat frame and forwardly collapsible over the lower surface of the seat frame. The chair, in one embodiment, further comprises front legs hinged to the seat frame and collapsible over the back legs. In an assembled state, the back legs and the backrest frame each abut against elements of the chair at joint surfaces, which limit the range of motion of the hinged members to thereby create a chair having a rigid support structure. In one embodiment, the seat frame, backrest frame, and back legs unfold into an interlocked configuration enhancing the stability of the chair.

DESCRIPTION OF THE DRAWINGS

FIG. 1B is a perspective view of the first embodiment of the present invention in an assembled configuration.

FIG. 1C is a perspective view of another embodiment of the present invention showing an alternate seat surface for use in the folding chair.

DESCRIPTION OF PREFERRED EMBODIMENT(S)

Figure 1A:
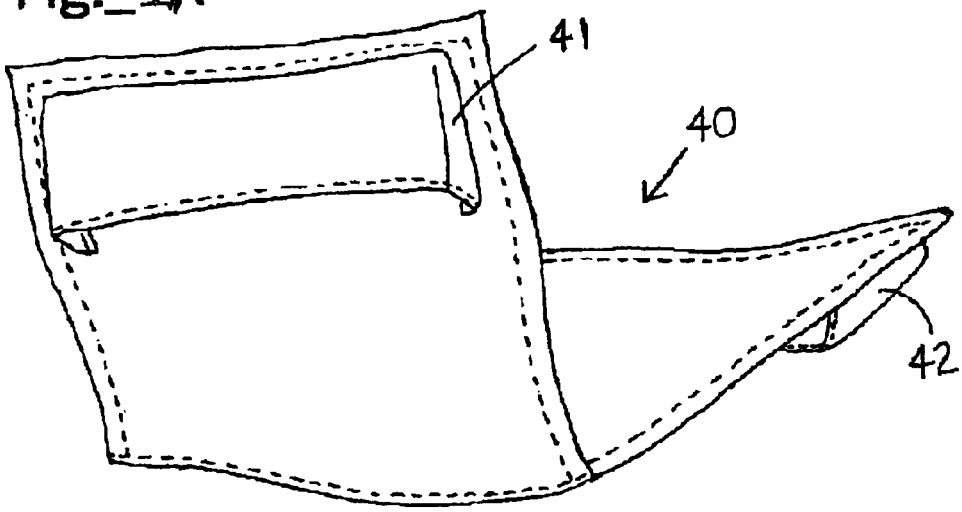
FIG. 1A is a perspective view of a folding chair according to a first embodiment of the present invention.
Figure 1A:
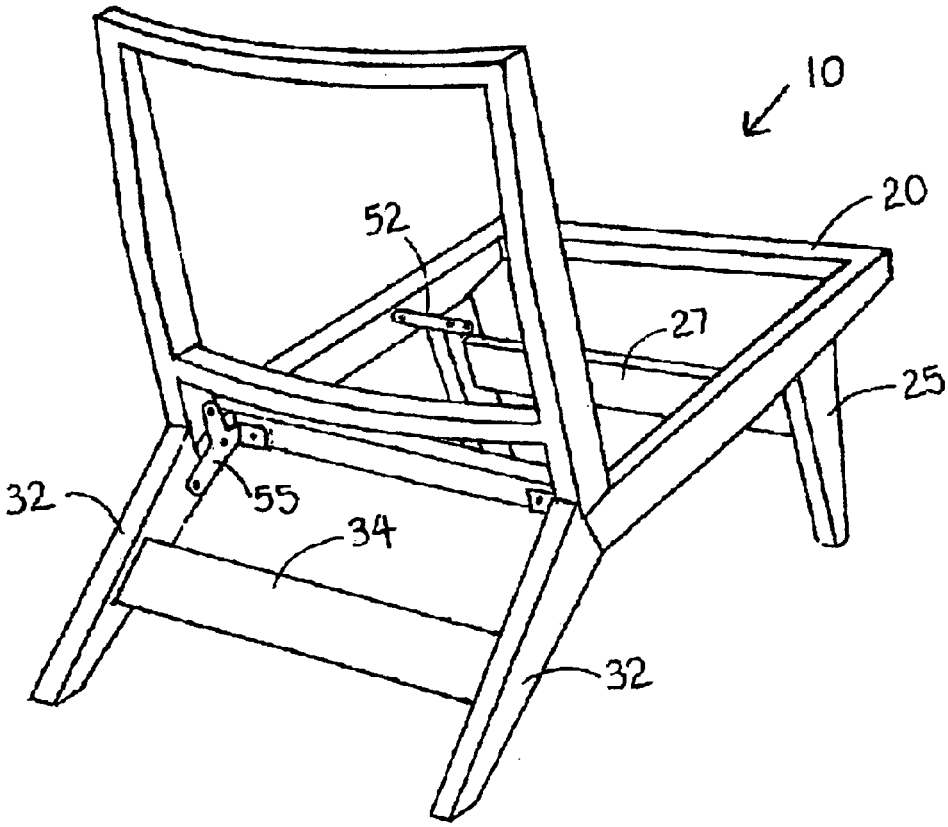

FIG. 1A sets forth a folding chair according to a first embodiment of the present invention. As FIG. 1A shows, folding chair 10 generally comprises seat frame 20, backrest frame 30, back legs 32, and front legs 25. As the various Figures illustrate, backrest frame 30, in one embodiment, comprises upper and lower cross members attached to opposing lateral uprights. As described more fully below, laterally opposing hinges, such as hinges 55, join seat frame 20, backrest frame 30 and back legs 32 to create a folding assembly. Hinges 52 pivotally attach front legs to seat frame 20 as shown in the various figures. Cross bar 34, in one embodiment, attaches back legs 32 to add stability to chair 10 and allow back legs 32 to move as a unit. Cross bar 27 similarly attaches front legs 25 to add stability to chair 10 and allow front legs 25 to move as a unit.

In one embodiment, seat cover 40 includes pocket flaps 41 and 42 that engage the ends outer ends of seat frame 20 and backrest frame 30 (as shown in FIG. 1B) to provide a seat surface. As FIG. 1C provides, however, backrest frame 30 and seat frame 20 may include slats 42 instead of seat cover 40. Of course, a variety of other configurations can be employed, such as the use of springs traversing the frames and a seat cushion disposed over the springs (not shown).

Figure 2A:
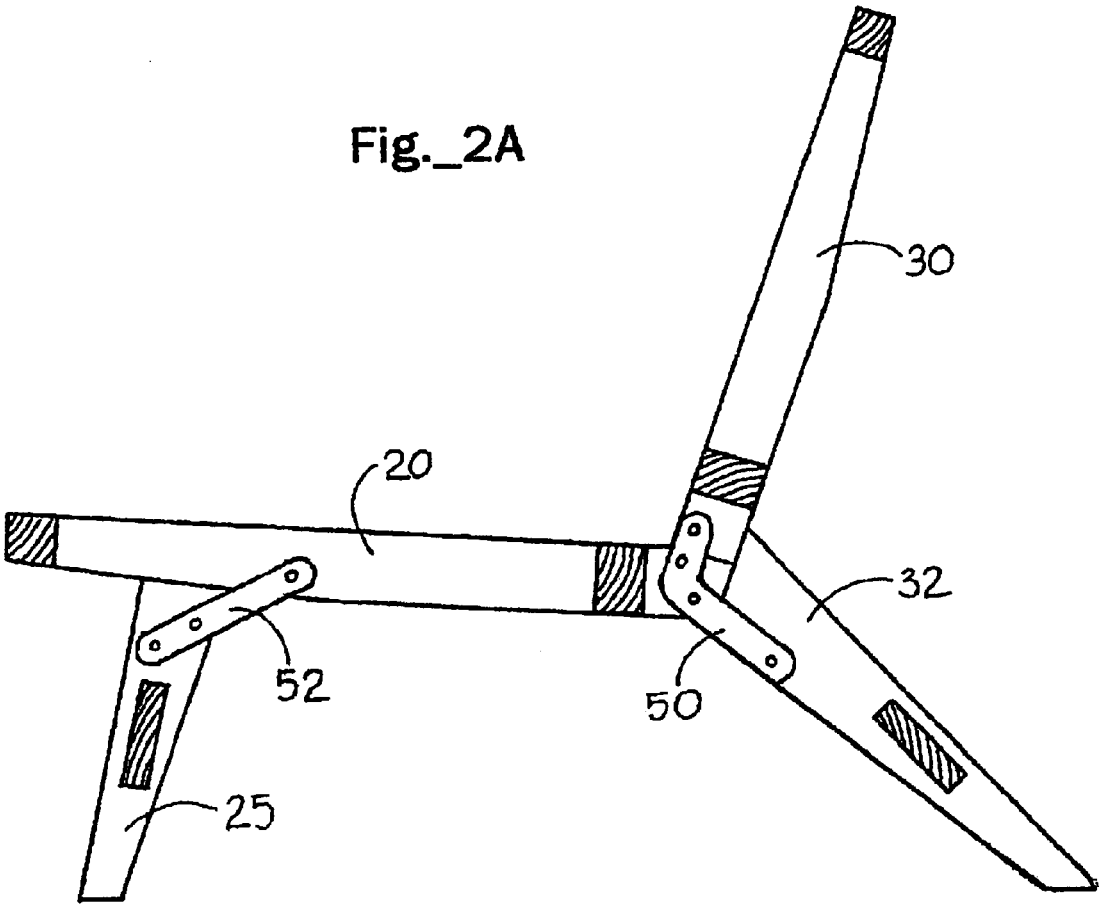
FIG. 2A is a sectional plan view illustrating the hinges associated with the first embodiment of the present invention, and showing the folding chair in an assembled state.
Figure 3A:
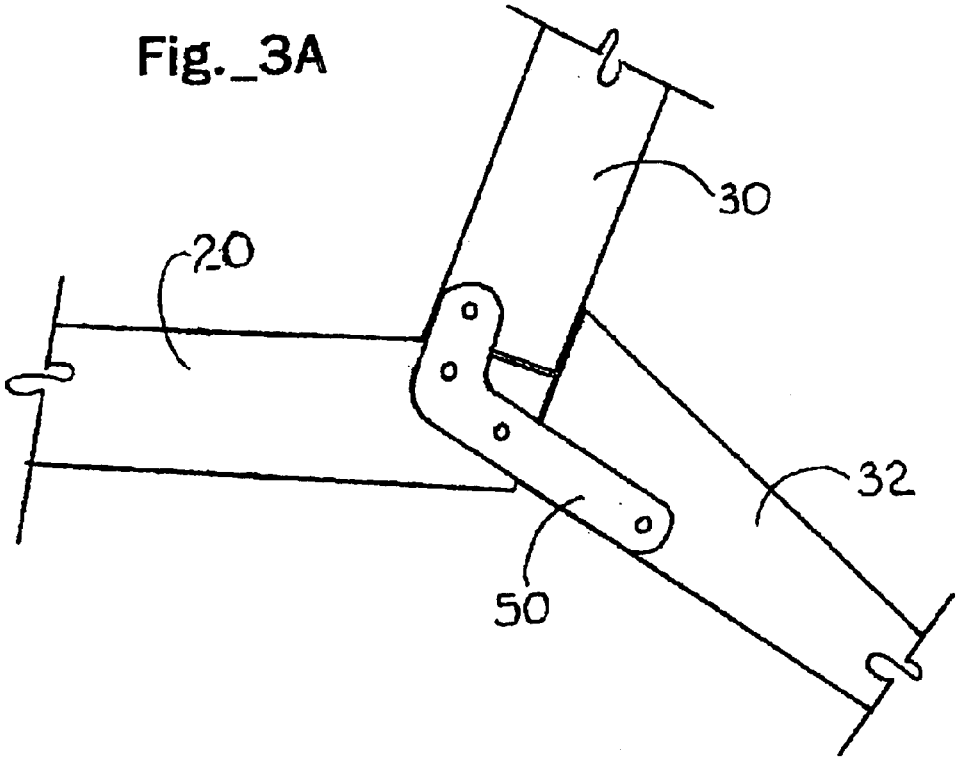
FIG. 3A is a sectional plan view illustrating the hinge and joint surface configuration associated with the first embodiment of the present invention.
Figure 4A:
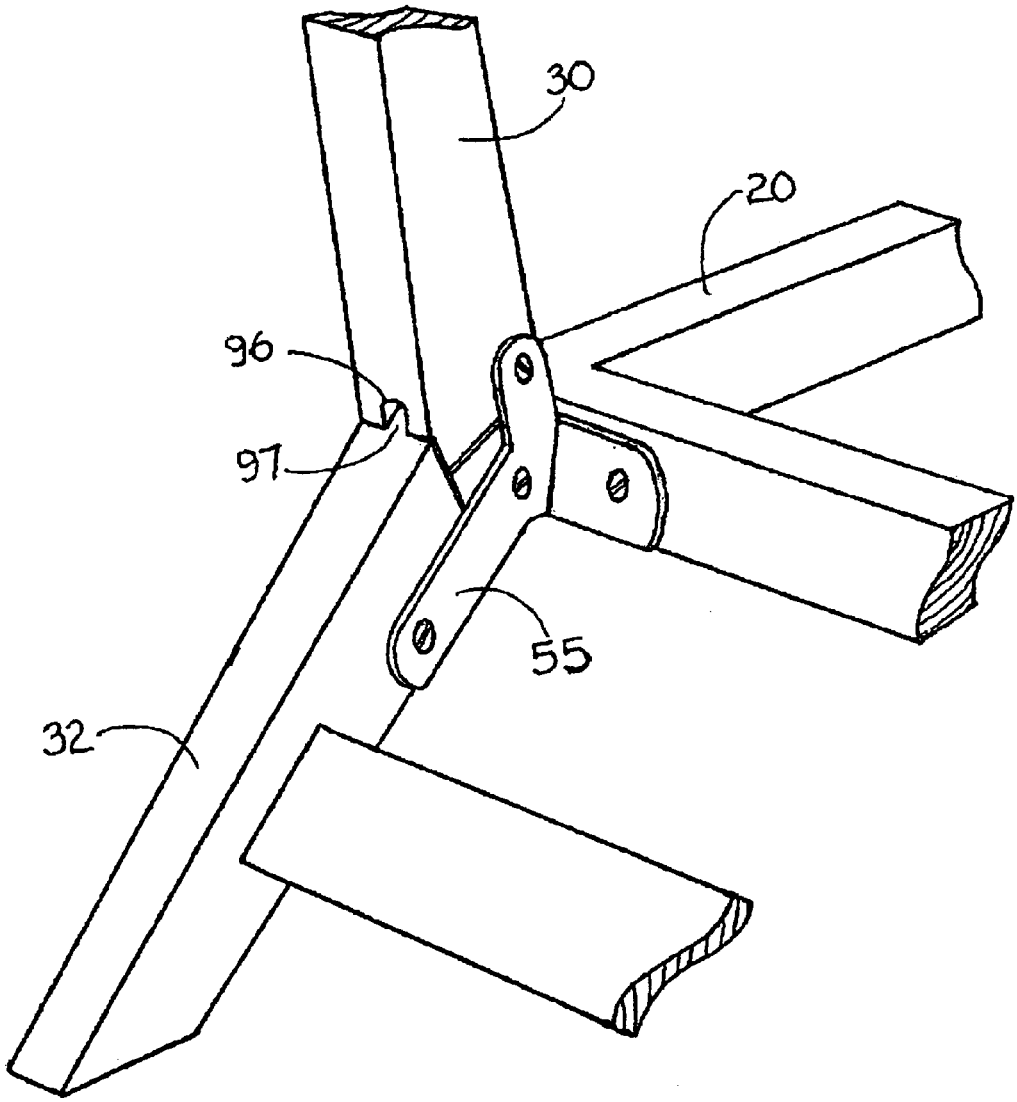
FIG. 4A is perspective sectional view showing a hinge mounted to the inner surface of the seat frame.
Figure 4B:
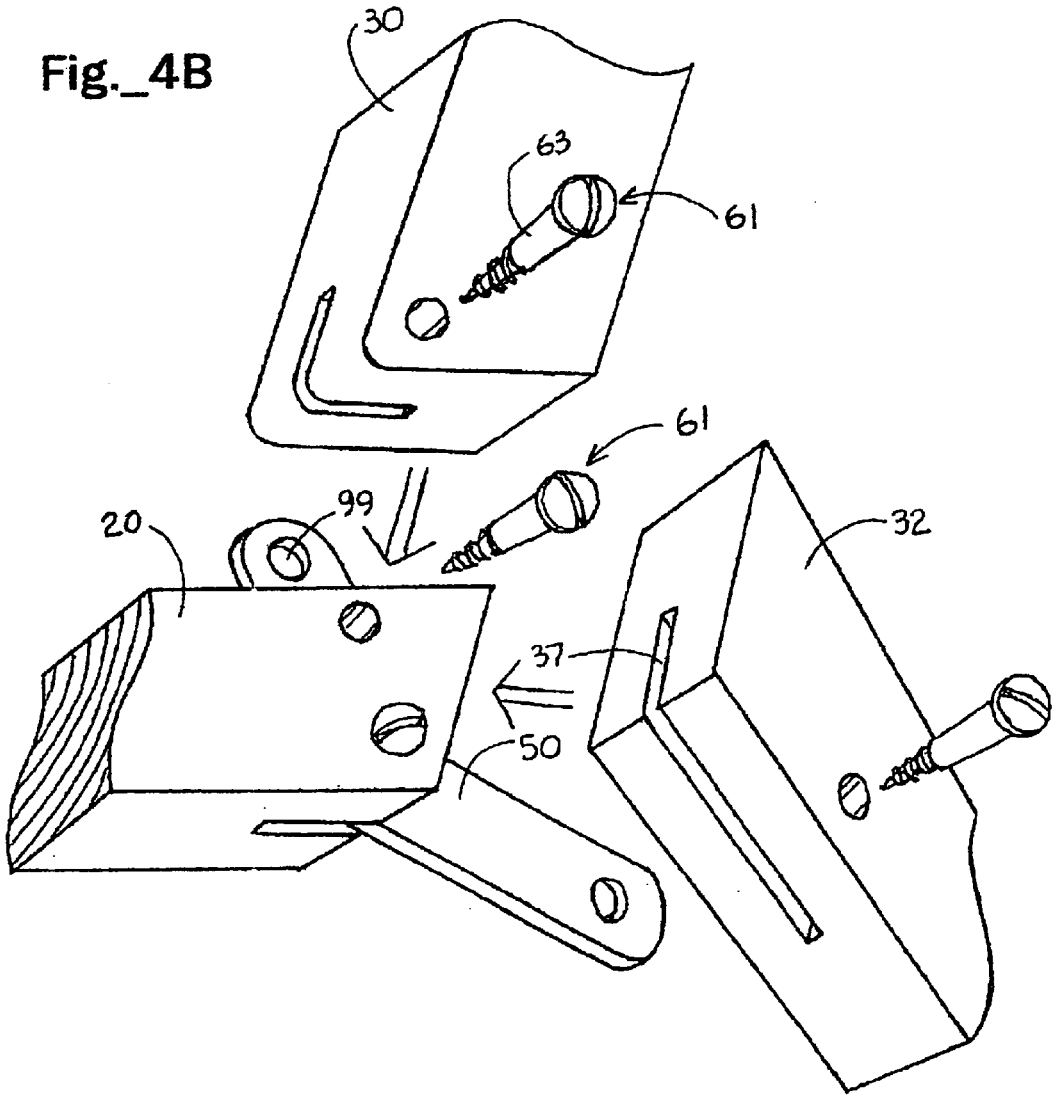
FIG. 4B is an exploded perspective view showing an embedded hinge configuration for use in embodiments of the present invention.

FIGS. 2A and 3A illustrate a hinge configuration according to one embodiment of the present invention. Specifically, hinges 50 pivotally attach backrest frame 30 and back legs 32 to seat frame 20 as shown. In one embodiment, hinges 50 are fixed to opposing inside surfaces of seat frame 20 in a conventional manner with screws (see, e.g., FIGS. 2A and 3A). However, hinges 50 may be mounted to opposing outside surfaces of seat frame 20. As FIG. 4B shows, hinges 50 may also be embedded within opposing lateral sides of seat frame 20. In one embodiment, screws pivotally secure back rest frame 30 to hinge 50. In one embodiment, the screws are conventional screws having a threadless shank region that engages a corresponding hole in hinge 50 and allows backrest frame 30 to smoothly pivot about the flat shank region of the screw (see FIG. 4B). Back legs 32 are pivotally attached to hinge 50 in the same manner. In addition, hinge 50 can be flat (as shown in FIG. 2A) or can be bent to attach to the rear crossing member of seat frame 20 (see FIG. 4A). Still further, as FIG. 4A provides, back legs 32 may include tongues 96, which engage corresponding grooves 97 in backrest frame 30. As one skilled in the art will recognize, similar features can be incorporated into other embodiments discussed below.

Figure 2B:
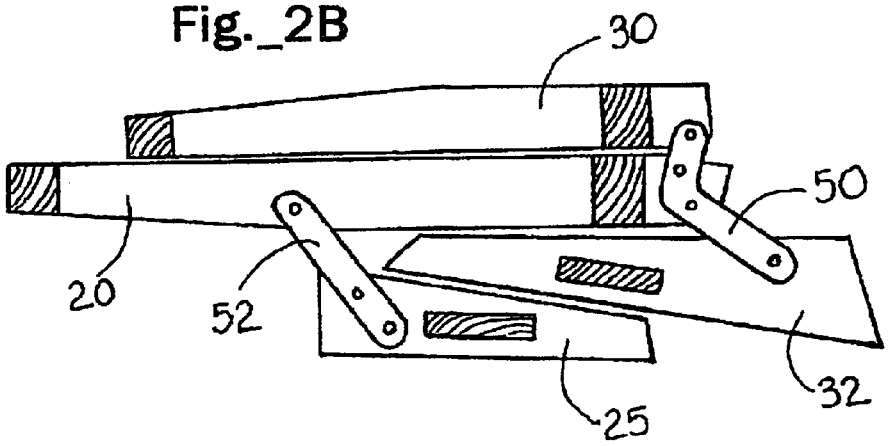
FIG. 2B is a sectional plan view of the first embodiment of the present invention in a folded configuration.

In a first embodiment, hinges 50 pivotally attach backrest frame 30 proximally to the rear edge of seat frame 20. As FIG. 2B shows, backrest frame is forwardly collapsible over the upper surface of seat frame 20. In an assembled state, however, backrest frame 30 abuts against the upper surface of seat frame 20 at a joint surface and extends upwardly as shown. The joint surfaces of the backrest frame 30, in one embodiment, are located on the lower respective ends of each opposing lateral upright. In addition, hinge 50 pivotally attaches back legs 32 to the rear edge of seat frame 20 at opposing sides thereof. Similar to backrest frame 30, back legs 32 are forwardly collapsible over the lower surface of seat frame 20 (see FIG. 2B). When folding chair 10 is assembled, the joint surfaces of back legs 32 abut against the rear surface of seat frame 20 and the rear surface of backrest frame 30 to interlock seat frame 20, backrest frame 30 and back legs 32 (see FIG. 3A). As FIG. 2B shows, hinges 52 pivotally attach front legs 25 to seat frame 20. Front legs 25 abut against the lower surface of seat frame 20 when chair 10 is assembled, and fold rearwards over back legs 32 when chair 10 is in a folded configuration.

Figure 3B:
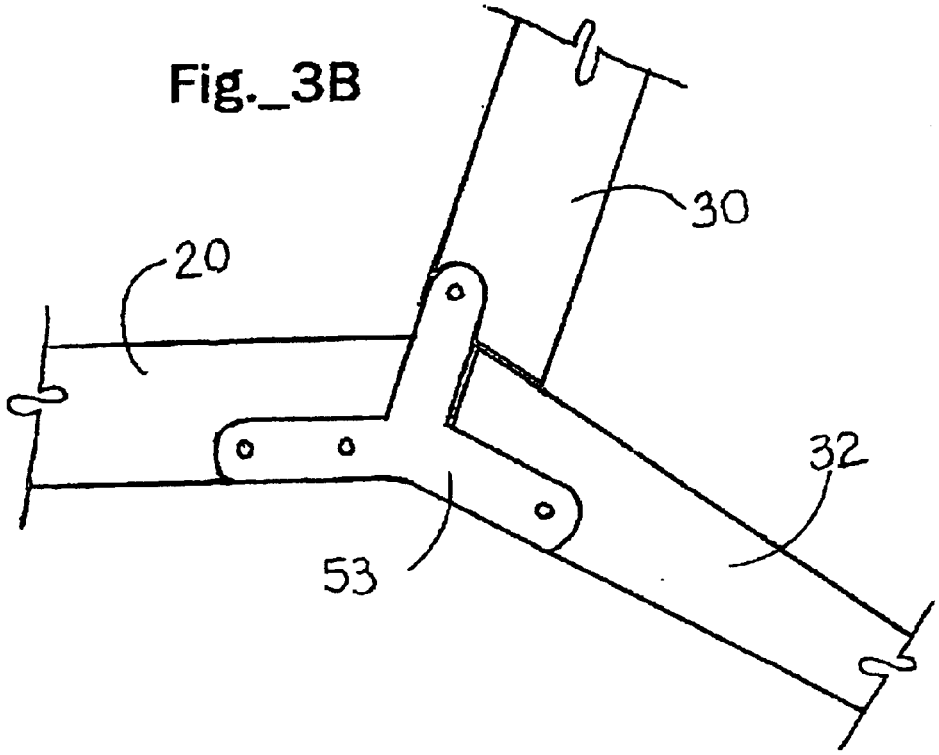
FIG. 3B is a sectional plan view illustrating the hinge and joint surface configuration corresponding to a second embodiment of the present invention.

As the various Figures illustrate, the novel hinge and joint surface configuration of the present invention has application in a wide array of embodiments. As FIG. 3B provides, Y-shaped hinge 53 pivotally attaches back legs 32 such that the joint surfaces of back legs 32 abut against the rear edge of seat frame 20 when chair 10 is assembled. Y-shaped hinge 53 also pivotally attaches backrest frame 30. When chair 10 is assembled backrest frame 30 abuts against the upper surface of back legs 32 to interlock seat frame 20, backrest frame 30 and back legs 32. As one skilled in the art will recognize, the order in which backrest frame 30 and back legs 32 are unfolded depend on how such members interlock.

Figure 3C:
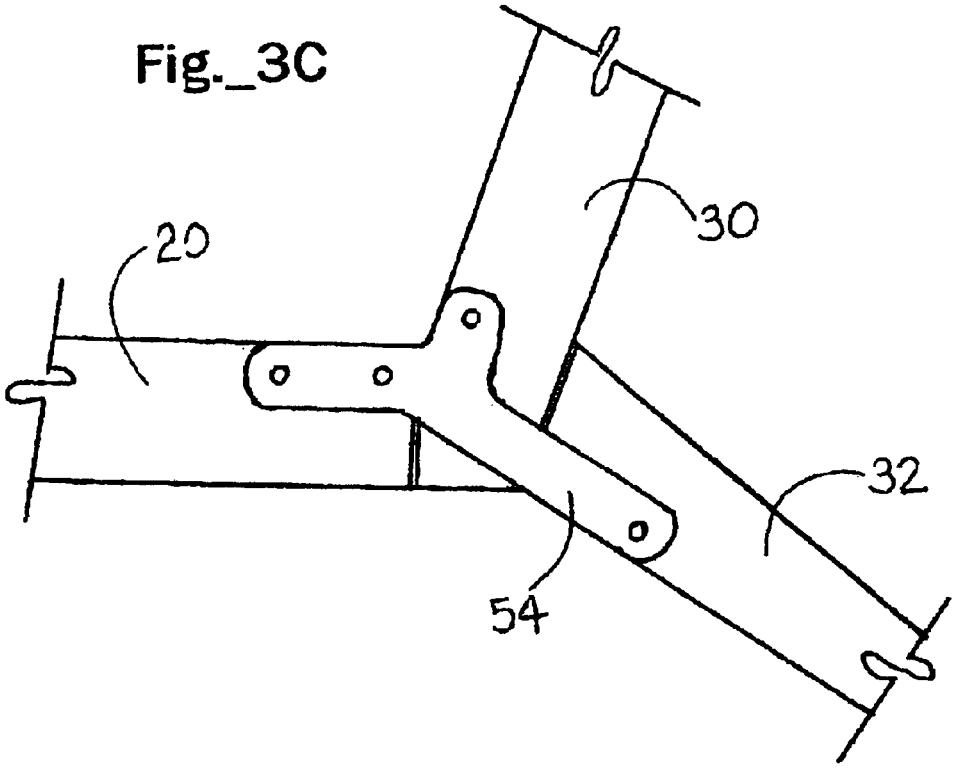
FIG. 3C is a sectional plan view showing the hinge and joint surface configuration associated with a third embodiment of the present invention.

FIG. 3C illustrates an alternative embodiment where Y-shaped hinge 54 pivotally attaches backrest frame 30 such that it abuts against the rear edge of seat frame 20 when chair 10 is assembled. As FIG. 3C shows, back legs 32 abut against the rear surface of backrest frame 30 to interlock seat frame 20, backrest frame 30 and back legs 32.

Figure 3D:
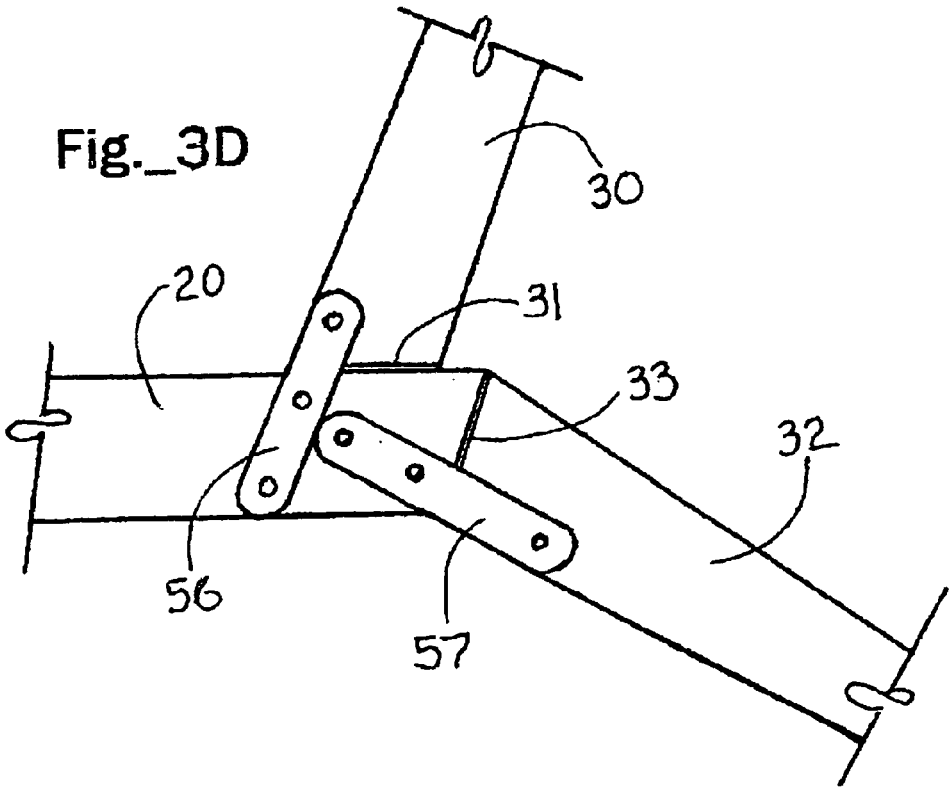
FIG. 3D is a sectional plan view setting forth the hinge and joint surface configuration of a fourth embodiment of the present invention.

FIG. 3D provides yet another embodiment of the present invention featuring a two-piece hinge structure. As FIG. 3D shows, hinge 56 pivotally attaches backrest frame 30 proximally to the rear edge of seat frame 20. As above, backrest frame 30 is forwardly collapsible over the upper surface of seat frame 20. Backrest frame 30 abuts against seat frame 20 at joint surface 31 and extends at an upward angle relative to seat frame 20 when chair 10 is assembled. In addition, hinge 57 pivotally attaches back legs 32 to the rear edge of seat frame 20. As FIG. 3D illustrates, when chair 10 is assembled, back legs 32 abut against seat frame 20 at joint surface 33 and extend at a downward angle relative to seat frame 20.

FIG. 4B illustrates an alternate placement for the hinges; that is, FIG. 4B shows hinge 50 embedded in and fixed to seat frame 20. Similarly, hinge 50 extends into groove 36 of back rest frame 30 and is pivotally attached thereto by screw 61. In one embodiment, unthreaded surface 63 engages hole 99 of hinge 50 when screw 61 is screwed into backrest frame 30. In addition, hinge 50 extends into groove 37 of back leg 32 and is pivotally attached thereto in a similar manner.

Lastly, although the present invention has been described with reference to specific embodiments, various other embodiments are possible without departing from the scope of the present invention. Other embodiments of the present invention will be apparent to one of ordinary skill in the art. It is, therefore, intended that the claims set forth below not be limited to the embodiments described above.

What is claimed is:

1. A folding seat comprising a seat frame, a backrest frame including first and second opposing latteral uprights hinged to the rear edge of said seat frame, wherein the backrest frame is forwardly collapsible over the upper surface of said seat frame, wherein the opposing lateral uprights of said back rest frame, in an assembled state, abut against the upper surface of said seat frame;

first and second back legs hinged to the rear edge of said seat frame at opposing sides thereof, said back legs forwardly collapsible over the lower surface of said seat frame, wherein said first and second back legs abut against the rear outer surface of the seat frame and the rear surface of the first and second opposing lateral uprights of the backrest frame to interlock said seat frame, said backrest frame and said back legs when the folding seat is assembled.

2. The folding seat of claim 1 further comprising first and second front legs attached to said seat frame, and wherein the first and second back legs extend at an angle greater than ninety degrees relative to the seat frame.

3. The folding seat of claim 2 wherein said front legs are hinged to said seat frame; said front legs collapsible over said back legs when said back legs are folded under said seat frame.

4. The folding seat of claim 2 further comprising a cross bar attached said first and second front legs.

5. The folding seat of claim 1 further comprising a cross bar attached to said first and second back legs.

6. The folding seat of claim 1 further comprising first and second L-shaped hinges attached to opposing lateral sides of said seat frame, said first and second L-shaped hinges extending upwardly to pivotally attach said back rest frame, said first and second L-shaped hinges extending beyond the rear edge of said seat frame to pivotally attach said back legs.

7. The folding seat of claim 6 wherein the first and second L-shaped hinges are embedded within said seat frame, said back leg, and said backrest frame.

8. The folding seat of claim 1 wherein the back rest frame further comprises an upper horizontal member extending between the first and second opposing lateral uprights.

9. The folding seat of claim 8 wherein the back rest frame further comprises a lower horizontal member extending between the first and second opposing lateral uprights.

10. A folding seat comprising a seat frame including a rearward-facing outer surface, a backrest frame comprising first and second opposing lateral uprights hinged proximally to the rearward-facing outer surface of said seat frame, said backrest frame forwardly collapsible over the upper surface of said seat frame;

first and second back legs hinged proximally to the rearward-facing outer surface of said seat frame at opposing sides thereof, said back legs forwardly collapsible over the lower surface of said seat frame;

wherein said back legs, in an assembled state, abut against the rearward-facing outer surface of said seat frame and extend at a downward angle relative to said seat frame;

wherein the first and second opposing lateral uprights of said backrest frame, in an assembled stare, abut against the upper surfaces of said back legs and extend at an upward angle relative to said seat frame; and first and second front legs hinged to said seat frame; said front legs rearward collapsible over said back legs when said back legs are in a folded configuration.

11. The folding seat of claim 10 further comprising first and second Y-shaped hinges fixed to opposing lateral sides of said seat frame, the prongs of said Y-shaped hinges extending beyond the rearward-facing outer surface of said seat frame; wherein the upper prongs of said Y-shaped hinges pivotally attach to the opposing lateral uprights of said backrest frame; and wherein said lower prongs of said Y-shaped hinges pivotally attach said back legs.

12. The folding seat of claim 11 wherein said first and second Y-shaped hinges are embedded in said seat frame, said opposing lateral uprights of said backrest frame and said back legs.

13. The folding seat of claim 10 further comprising a cross bar attached to said first and second back legs.

14. A folding seat comprising a seat frame including first and second opposing lateral members, the first and second opposing lateral members each including a rear outer surface, a backrest frame hinged to the rear edge of said seat frame and forwardly collapsible over the upper surface of said seat frame; wherein the backrest frame comprises at least one cross member extending between opposing lateral uprights, wherein the opposing lateral uprights of said backrest frame, in an assembled state, abut against the upper surfaces of the first and second opposing lateral members of said seat frame;

first and second back legs hinged to the rear edge of said seat frame at opposing sides thereof and forwardly collapsible over the lower surface of said seat frame;

wherein said back legs abut against the rear outer surfaces of the first and second opposing lateral members of said seat frame at respective joint surfaces and extend at a downward angle relative to said seat frame; and first and second front legs hinged to said seat frame; said front legs rearward collapsible over said back legs when said back legs are in a folded configuration.

15. The folding seat of claim 14 further comprising first and second hinges attached to the first and second opposing lateral members of said seat frame and extending upwardly to pivotally attach said back rest frame.

16. The folding seat of claim 15 further comprising third and fourth hinges attached to the first and second opposing lateral members of said seat frame and extending beyond the rear edge of said seat frame to pivotally attach said first and second back legs, respectively.

17. The folding seat of claim 15 wherein said first and second hinges are embedded within said seat frame and said backrest frame.

18. The folding seat of claim 16 wherein said third and fourth hinges are embedded within said seat frame and said first and second back legs, respectively.

19. The folding seat of claim 14 wherein the first and second opposing lateral members of the seat frame includes first and second tongues engaging corresponding grooves in said respective first and second back legs.

20. A joint for use in a folding seat comprising a seat frame, and a backrest frame, the joint comprising a lateral seat member of the seat frame, a lateral upright of the backrest frame hinged to the rear edge of the lateral seat member and forwardly collapsible over the upper surface of said seat frame, wherein the lateral upright, in an assembled state, abuts against the upper surface of the lateral seat member;

a back leg hinged to the rear edge of the lateral seat member and forwardly collapsible over the lower surface of the lateral seat member; wherein the back leg abuts against the rear outer surface of the lateral seat member and the rear surface of the lateral upright to interlock the lateral seat member, the lateral upright and the back leg when the folding seat is assembled.

21. A joint for use in a folding seat comprising a seat frame, and a backrest frame, the joint comprising a lateral seat member of the seat frame, wherein the lateral seat member includes a rearward-facing outer surface, a lateral upright of the backrest frame hinged to the rear edge of the lateral seat member and forwardly collapsible over the upper surface of said seat frame, a back leg hinged proximally to the rearward-facing outer surface of the lateral seat member and forwardly collapsible over the lower surface of the lateral seat member;

wherein said back leg, in an assembled state, abuts against the rearward-facing outer surface of the lateral seat member and extends at a downward angle relative to the seat frame;

wherein the lateral upright, in an assembled state, abuts against the upper surface of the back leg and extends at an upward angle relative to the lateral seat member.

* * * * *

UNITED STATES PATENT AND TRADEMARK OFFICE

CERTIFICATE OF CORRECTION

PATENT NO. : 6,877,804 B2
DATED : April 12, 2005
INVENTOR(S) : Chan

It is certified that error appears in the above-identified patent and that said Letters Patent is hereby corrected as shown below:

Column 4,
Line 14, replace "latteral" with -- lateral --

Column 5,
Line 7, replace "stare" with -- state --

Signed and Sealed this

Fifth Day of July, 2005

JON W. DUDAS
*Director of the United States Patent and Trademark Office*